United States Patent [19]

Cole

[11] 4,201,806

[45] May 6, 1980

[54] SPRAY DECORATION

[76] Inventor: Bernard M. Cole, 7 Park Dr. East, Old Westbury, N.Y. 11568

[21] Appl. No.: 869,715

[22] Filed: Jan. 16, 1978

[51] Int. Cl.[2] ..... D04D 7/10

[52] U.S. Cl. ..... 428/4; 24/18; 29/428; 428/11; 428/115

[58] Field of Search ..... 206/457; 428/18, 19, 428/20, 4, 5, 7, 31, 28, 115, 11; 156/187; 29/428; 24/18; D11/121

[56] References Cited

U.S. PATENT DOCUMENTS

| | | | |
|---|---|---|---|
| 360,000 | 3/1887 | Darnall | 428/10 X |
| 1,578,703 | 3/1926 | Aronson | 428/24 X |
| 1,748,636 | 2/1930 | Crockett | 428/26 |
| 1,896,060 | 1/1933 | Colby | 428/28 |
| 2,064,826 | 12/1936 | Gabriel | 428/28 X |
| 2,226,349 | 12/1940 | Royle | 428/19 |
| 2,514,777 | 7/1950 | Brown, Jr. | 428/24 X |
| 2,736,182 | 2/1956 | James | 428/5 X |
| 2,849,821 | 9/1958 | Doig | 428/5 |
| 2,888,816 | 6/1959 | Kanost | 428/7 X |
| 3,010,236 | 11/1961 | Doig | 428/5 |
| 3,041,767 | 7/1962 | Ranoha et al. | 428/20 |
| 3,056,223 | 10/1962 | Crane | 156/187 X |
| 3,133,851 | 5/1964 | Reukauf | 428/18 |
| 3,174,886 | 3/1965 | Miscovich | 428/4 X |
| 3,176,361 | 4/1965 | Jensen | 428/4 X |
| 3,370,779 | 2/1968 | Cole | 428/4 X |
| 3,457,134 | 7/1969 | Karkoska | 428/11 X |
| 4,014,088 | 3/1977 | Oshier | 428/24 X |
| 4,055,840 | 10/1977 | Uchytil et al. | 404/9 X |

FOREIGN PATENT DOCUMENTS

| | | | |
|---|---|---|---|
| 529291 | 7/1931 | Fed. Rep. of Germany | 428/4 |
| 1157762 | 11/1963 | Fed. Rep. of Germany | 428/4 |

*Primary Examiner*—Henry F. Epstein
*Attorney, Agent, or Firm*—James & Franklin

[57] ABSTRACT

A spray-like decorative ornament for use in gift-wrapping a package comprises a rigidifying core having top and bottom edges and a strip of metal foil wound about the core, a section of the strip being of greater height than the core and the top portion of the strip being vertically slit to define a plurality of fingers. Preferably the strip tapers substantially smoothly from one end thereof to the other, with a portion of the strip radially closer to the core having taller fingers than the portion of the strip radially further from the core, thereby to produce a spray-like appearance. In one preferred embodiment the core is hollow and the ornament additionally includes an elasticized cord having a section of enlarged diameters incapable of passing through the core, the core being slidably mounted on a loop of the cord passing longitudinally therethrough with the enlarged section at least partially disposed above the core top portion. In another preferred embodiment the strip bottom edge is continuous and in substantially a single horizontal plane, the elasticized cord passing transversely through the core and extending out beyond the ornament.

12 Claims, 5 Drawing Figures

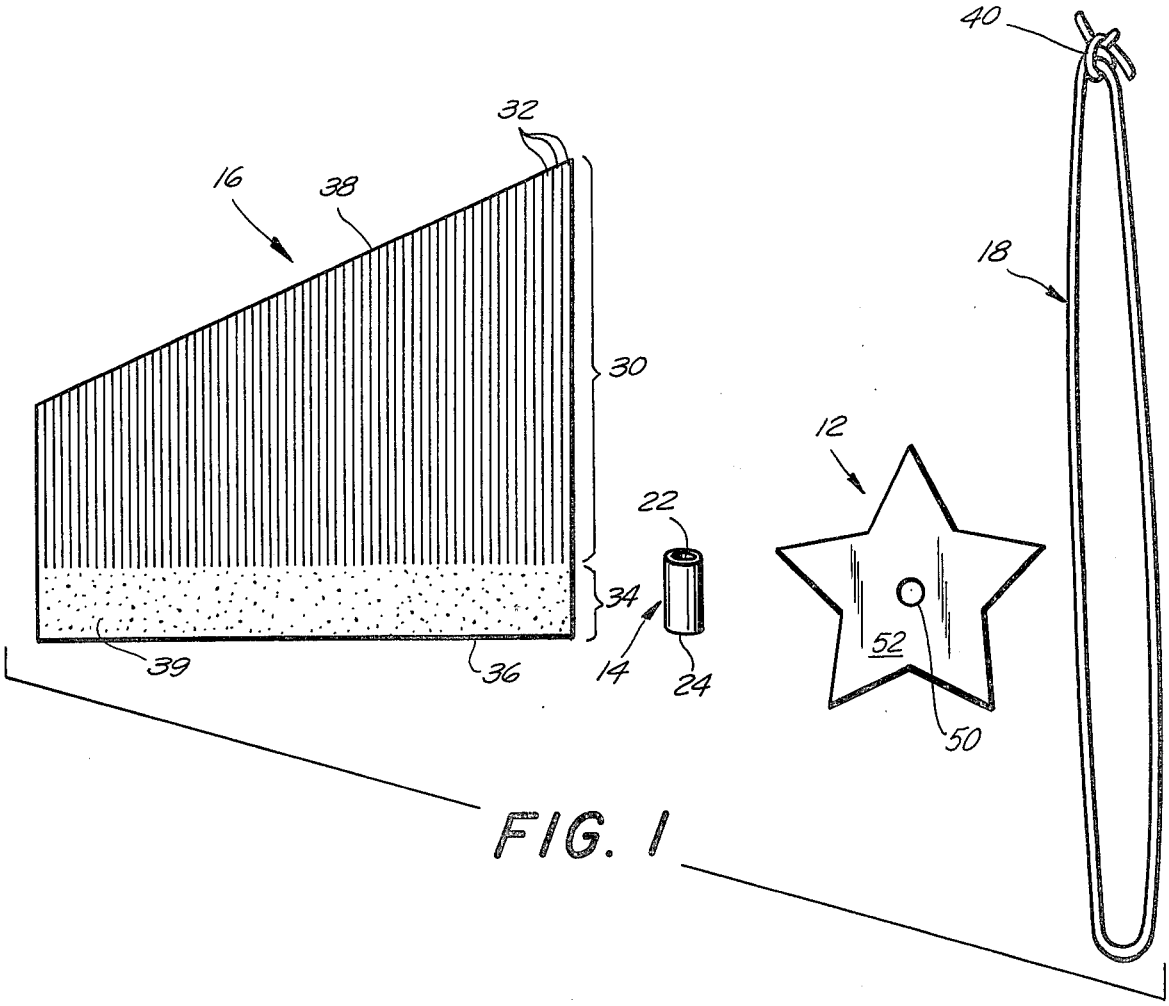
FIG. 1
FIG. 3
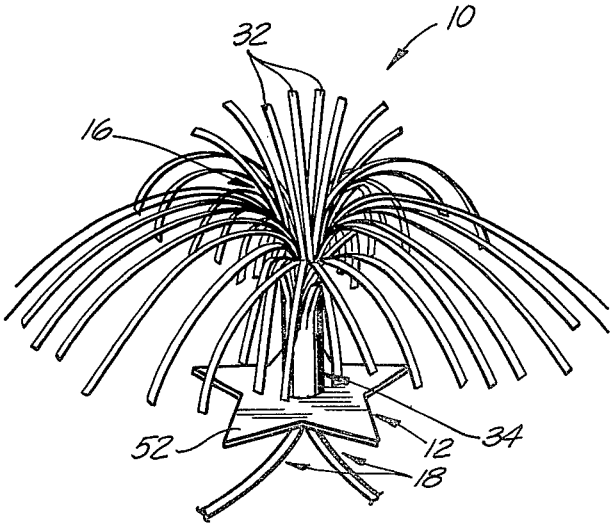
FIG. 2
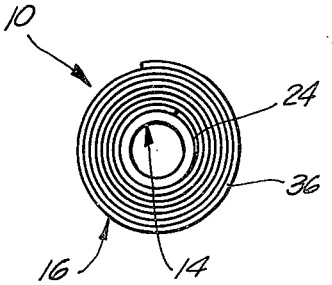

FIG. 4
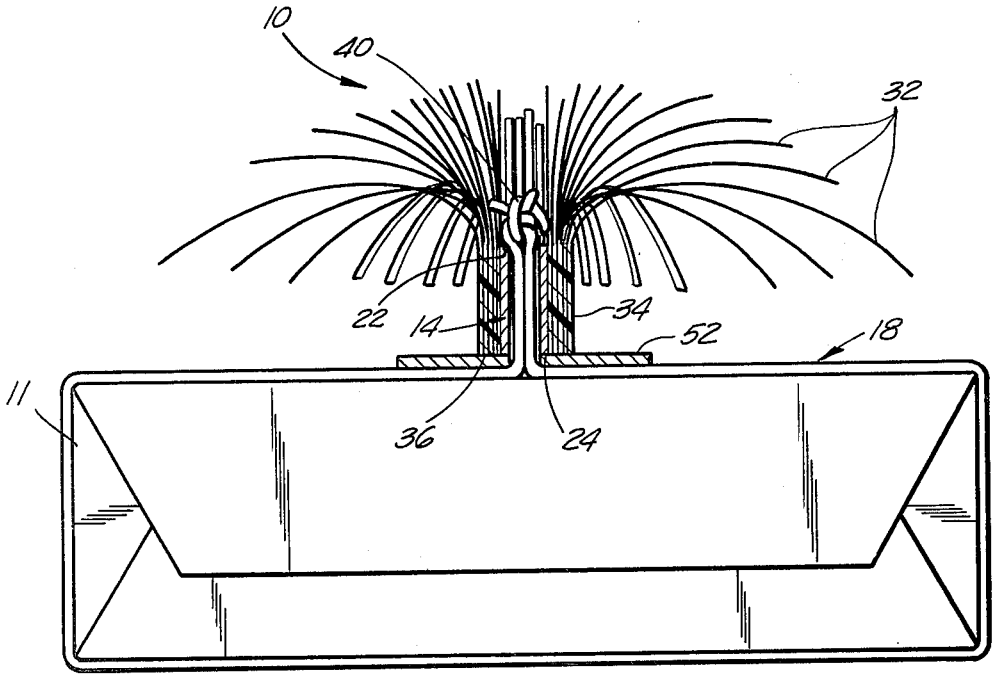
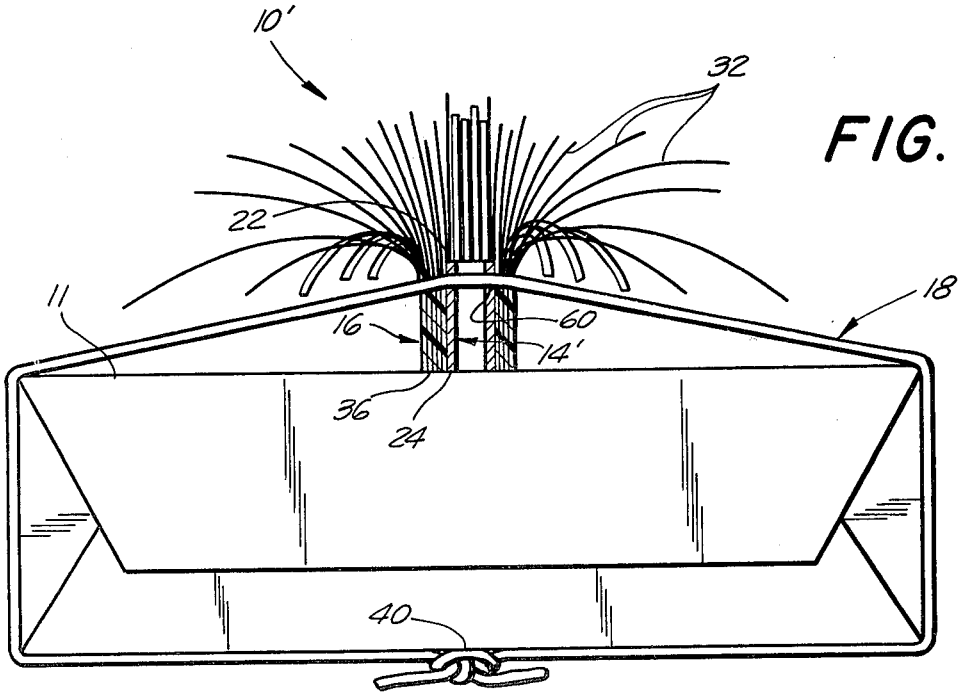
FIG. 5

SPRAY DECORATION

BRIEF DESCRIPTION OF THE PRIOR ART

The present invention relates to decorative ornaments for use in gift-wrapping a package, and more particularly to such an ornament which has a spray-like appearance.

Decorative ornaments for use in gift-wrapping packages are well known in the art. Such an ornament should be simple and inexpensive to manufacture (to maintain a low purchase cost for the ornament), easily and rapidly applied to the package (to minimize the cost of performing the gift-wrapping), and securely attachable to the package (so that the gift recipient has an opportunity to view the ornament on the package, and not detached therefrom). However, none of the known decorative ornaments are capable of providing an aesthetically-appealing spray- or fountain-like appearance and at the same time meeting all of the aforesaid requiremens for a successful gift-wrapping ornament.

Accordingly, it is an object of the present invention to provide such an ornament having an aesthetic spray-like appearance.

Another object is to provide such an ornament which is simple and inexpensive to manufacture, easily and rapidly applied to the package and securely attachable thereto.

SUMMARY OF THE INVENTION

It has now been found that the above and related objects of the present invention are obtained in a spray-like decorative ornament for use in gift-wrapping a package comprising a rigidifying core having top and bottom edges and a strip of metal foil wound about the core. A section of the strip is of greater height than the core, and the top portion of the strip is vertically slit to define a plurality of fingers.

In one preferred embodiment, the core is hollow and the ornament may additionally include an elasticized cord having a section of enlarged diameter incapable of passing through the core. The core is slidably mounted on a loop of the cord passing longitudinally therethrough with the enlarged section being at least partially disposed above the core top portion. Preferably the cord section of enlarged diameter comprises a knot joining the end portions of the cord together to form the cord loop. In order to further enhance the aesthetic appeal of the ornament and to insure that the ornament remains in its desired upright position on the package, the ornament may additionally include a substantially planar stabilizing element slidably mounted on a loop of the cord beneath the core. The stabilizing element has a top surface extending outwardly beyond the core bottom edge and being adapted to abut the core bottom edge under the influence of the cord when the cord loop is stretched about a package. The stabilizing element is preferably more rigid than the metal foil of the strip.

In another preferred embodiment, the bottom edge of the strip is continuous and in substantially a single horizontal plane, the core bottom edge preferably lying in substantially the same horizontal plane. The fingers preferably extend downwardly toward the strip bottom edge below the core top edge; in other words, the core top edge is disposed below the bottoms of the fingers. The ornament may additionally include an elasticized cord passing transversely through the core and extending out beyond the ornament, the portion of the cord extending beyond the core defining a loop adapted to be stretched about a package.

In both of the embodiments described above, the metal foil strip preferably tapers substantially smoothly from one end thereof to the other end. The portion of the strip radially closer to the core is designed to have taller fingers than the portion of the strip radially further from the core; in other words, the fingers increase in length from the radially inner portion of the winding formed by the strip to the radially outer portion thereof. As the shorter fingers are more capable of standing upright under their own weight than are the taller fingers (which tend to bow outwardly and then downwardly under their own weight), the ornament has a desirable spray-like appearance.

BRIEF DESCRIPTION OF THE DRAWING

FIG. 1 is an exploded plan view of the elements of an ornament according to one embodiment of the present invention;

FIG. 2 is a bottom plan view of the ornament showing the strip wound about the rigidifying core;

FIG. 3 is an isometric view of the ornament;

FIG. 4 is a side elevation view of the ornament, partially in cross-section, the cord thereof being stretched over a gift-wrapped package; and FIG. 5 is a side elevation view, partially in cross-section, of an ornament according to a second embodiment of the present invention, with the cord thereof being stretched over a gift-wrapped package.

DETAILED DESCRIPTION OF THE PREFERRED EMBODIMENTS

Referring now to FIGS. 1–4, therein illustrated is a first embodiment of a spray-like decorative ornament 10 for use in gift-wrapping a package 11. As illustrated in FIG. 1, the ornament 10 is comprised of a rigidifying core generally designated 14, a strip of metal foil generally designated 16, an optional elasticized cord generally designated 18, and an optional stabilizing element generally designated 12.

More particularly, the rigidifying core 14 is cylindrical in configuration and has a top edge 22 and a bottom edge 24. The core 14 is necessarily hollow in the first embodiment being described herein, although it is only optionally hollow in the second embodiment described herein below. The core may be formed of plastic or other conventional materials which are rigid relative to the unwound strip 16 and therefore capable of serving as a mandrel upon which the strip 16 may be wound.

The strip 16 of metal foil includes a top portion 30 (see FIG. 1) which is vertically slit to define a plurality of fingers 32 and an unslit bottom portion 34 defining a bottom edge 36. At least a section of the strip 16 is of greater height than the core 14, and generally the entire strip 16 will be of greater height than the core 14. As illustrated in FIGS. 2–4, the strip is wound repeatedly about the outer sidewall of the core 14 (and itself) with the continuous bottom edge 36 of the strip 16 preferably lying in substantially a single horizontal plane, typically the same horizontal a plane in which lies the core bottom edge 24. The fingers 32 of strip 16 extend downwardly toward the strip bottom edge 36 below the core top edge 22; in other words, the core top edge 22 is disposed above the bottoms of the fingers 32.

As best seen in FIG. 1, the strip 16 preferably tapers substantially smoothly from one end thereof to the other; that is, the upper edge 38 thereof defines a straight or substantially straight line when the strip 16 is in the laid out or unwound state. While each finger 32 is preferably cut on the basis at the top edge 38 thereof, as shown in FIG. 1, the strip 16 is also deemed to be substantially smoothly tapered if each finger 32 is cut at the top edge 38 thereof parallel to bottom strip edge 36, but with each finger 32 being of incrementally greater height from one end of the strip 16 to the other. As best seen in FIGS. 3–4, the portion of the strip 16 radially closer to the core 14 has taller fingers 32 than the portion of the strip 16 radially further from the core 14; in other words, the fingers 32 increase in length from the radially inner portion of the winding formed by the strip 16 to the radially outer portion thereof. As the metal foil from which the strip 16 is constructed has an appreciable rigidity, albeit far less than the rigidity of the core 14, the shorter or radially inner fingers 32 tend to stand upright or substantially upright, while the relatively longer or radially outward fingers 32 tend to bow outwardly under their own weight and eventually curve downwardly (towards the strip bottom edge 36). This produces the desired fountain—or spray-like appearance.

A thin layer of adhesive 39 may be applied to one surface of the laid-out or unwound strip bottom portion 34 to adhere the first winding of the strip 16 on the outer surface of the core 14, to maintain the subsequent windings of the strip bottom portion 34 in place upon themselves, and to maintain the last winding of the strip bottom portion 34 (i.e., the outer end thereof) in place on the preceeding winding. Of course, other conventional means for maintaining the layers of a winding in place may be utilized as desired.

Preferably the strip bottom edge 36 is continuous and lies in substantially the same single horizontal plane as the core bottom edge 24 when the strip 16 is wound about the core 14, thereby to provide the ornament with a flat, smooth bottom surface which may be utilized to adhere the strip/core unit to a package 11 without the use of a cord 18.

In a preferred embodiment, however, an optional elasticized cord 18 is used to secure the ornament 10 to the package 11. The elasticized cord 18 includes a section 40 of enlarged diameter incapable of passing through the core 14. The cord section 40 of enlarged diameter preferably comprises a knot joining the end portions of the cord 18 to form a cord loop. The cord loop has a minimum thickness equal to twice the thickness of the cord, but is capable of passing through the hollow of core 14 whereas the enlarged section or knot 40 thereof is of greater diameter and incapable of passing through the hollow of the core 14. As best shown in FIGS. 3 and 4, the core 14 is slidably mounted on the cord loop passing longitudinally therethrough, with the enlarged section or knot 40 being disposed above the core top portion 22. When the ornament 10 is in place on the package 11, the knot 40 tends to become buried in the fingers 32 and impossible to view except from a position above the ornament 10. The enlarged diameter section or knot 40 not only serves to interconnect the cord/core/strip unit by preventing the cord 18 from being pulled downwardly through the core 14, but also serves to bias the fingers 32 outwardly so that, to whatever degree the fingers 32 bow under their own weight, they tend to bow outwardly from the core 14.

It will be appreciated that the cord/core/strip unit described hereinabove may be utilized as such as the ornament, with the core/strip unit bottom surface 24,36 resting directly upon the cord loop under the influence of the cord 18 when the cord loop is stretched about a package 11. Practically speaking, however, if the unit is not perfectly balanced on the cord 18, a portion of the strip bottom edge 36, and possibly the core bottom edge 24, will contact the upper surface of the package 11, thereby to stabilize the ornament 10 in an upright position.

However in order to further stabilize the core/strip unit, in a preferred embodiment a substantially planar stabilizing element 12 is slidably mounted on the cord loop beneath the core 14. The stabilizing element 12 defines an aperture 50 therethrough and has a top surface 52 which extends outwardly beyond the core bottom edge 24 and is adapted to abut the core bottom edge 24 under the influence of the elasticized cord 18 when the cord loop is stretched about a package 11. The stabilizing element 12 is illustrated as having the configuration of a star (see FIGS. 1 and 3), but clearly any aesthetic configuration which does not interfere with the planar nature of the element (requisite for the stabilizing function thereof) may be utilized. The stabilizing element 12 acts as an enlarged base for the core/strip unit, thereby to assist in maintaining the unit in an upright position on a package 11. Preferably the stabilizing element 12 is more rigid than the metal foil of strip 16 to further enhance its performance of that function.

The ornament 10 described above is easily constructed by winding the strip bottom portion 34 about the outer surface of core 14, threading the cord loop of cord 18 downwardly through the hollow core 14 until the knot 40 abuts the upper core edge 22, threading the cord loop extending from beneath the core 14 through the aperture 50 of stabilizing element 12, and pushing the stabilizing element 12 upwardly until it abuts the bottom edge 24, 36 of the core/strip unit. The ornament 10 is thus simply and economically manufactured, and easily stored ready for use. To apply the ornament 10 to package 11, the gift-wrapped need only stretch the cord loop of cord 18 about the package 11, and the ornament 10 will automatically assume the appropriate upright position. If it should fail to do so, the gift-wrapper need only manually place the ornament 10 in its upright position and the tension in the cord loop about the package 11 will serve to maintain the unit 10 in the appropriate upright position.

Referring now to FIG. 5, therein illustrated is a second embodiment 10′ of the present invention in place on a package 11. The core 14′ is similar to the core 14 of the first embodiment 10, except that the core 14′ is longer (so that the top edge 22 thereof is spaced above the bottoms of the fingers 32) and the portion of the core 14′ extending above the bottoms of the fingers 32 contains a transverse aperture 60 therethrough (disposed intermediate the bottoms of the fingers 32 and the core top edge 22). The core 14′ may be hollow, as shown, or, if desired, solid. The strip 16 is wound about the core 14′ as in the first embodiment 10, except that in the second embodiment 10′ it is critical that the bottom edge 36 thereof be in substantially a single horizontal plane, preferably coextensive with the plane of the core bottom edge 24, in order to provide a planar base for maintaining the ornament 10′ in an upright position. If desired, a stabilizing element 12, either with or without the aperture 50, may be utilized, the upper surface 52 of the stabilizing element being adhered to the bottom edge of the core/strip unit. Whereas in the first embodiment 10 the cord 18 passed longitudinally through the core 14 (and stabilizing element aperture 50), in the second embodiment 10', the cord 18 extends transversely through the core 14'. More particularly an end portion of the cord 18 is threaded through the aperture 60 extending transversely through the core 14' prior to being joined together with the other end portion in a knot 40. Thus in the second embodiment 10' the bottom edges 24,36 of the core/strip unit (or the bottom surface of the stabilizing element 12, if one is used) directly abuts the upper surface of the package 11, the unit 10' being maintained in an upright position under the influence of the cord 18 when the cord loop stretched about the package 11. If desired, the cord 18 may be dispensed with, and the bottom of the ornament 10' (either the bottom edges 24,36 of the core/strip unit or the bottom surface of the stabilizing element 12, if one is used) directly adhered to the top surface of the package 11.

To summarize, the present invention provides a spray-like decorative ornament which is simple and economical to manufacture, easily and rapidly applied to a package by the gift-wrapper, and secure in its attachment to the package.

Now that the preferred embodiments of the present invention have been shown and described in detail, various modifications and improvements thereon will become readily apparent to those skilled in the art. Accordingly, the spirit and scope of the present invention is to be limited only by the appended claims, and not by the foregoing disclosure.

I claim:

1. A spray-like decorative ornament for use in gift-wrapping a package comprising:

A. a rigidifying core having a substantially cylindrical sidewall and top and bottom edges;

B. a strip of metal foil wound about said core, a section of said strip being of greater height than said core, the top portion of said strip being substantially smoothly tapered from a minimum height at one end thereof to a maximum height at the other end and being vertically slit to define a plurality of fingers, the bottom portion of said strip not being vertically slit and the bottom edge thereof being continuous and in substantially a single horizontal plane, said core and strip bottom edges forming an exposed planar abutment surface adapted to abut said package, said core top edge being disposed above the bottoms of said fingers; and C. an elasticized cord passing transversely through said core between said core top edge and the bottoms of said fingers and extending out beyond said ornament.

2. The ornament of claim 1 wherein a portion of said cord extending beyond said core defines a loop.

3. A spray-like decorative ornament for use in gift-wrapping a package comprising:

A. a hollow rigidifying core having a substantially cylindrical sidewall and top and bottom edges;

B. a strip of metal foil wound about said core, a section of said strip being of greater height than said core, the top portion of said strip being substantially smoothly tapered from a minimum height at one end thereof to a maximum height at the other end and being vertically slit to define a plurality of fingers;

C. an elasticized cord having a section of enlarged diameter incapable of passing through said core, said core being slidably mounted on a loop of said cord passing longitudinally therethrough with said enlarged section being at least partially disposed above said core top portion; and D. a substantially planar stabilizing element slidably mounted on a loop of said cord beneath said core, said element having a top surface extending outwardly beyond said core bottom edge and being adapted to abut said core bottom edge under the influence of said cord when said cord loop is stretched about a package.

4. The ornament of claim 3 wherein the bottom edge of said foil is continuous and in substantially a single horizontal plane.

5. The ornament of claim 4 wherein said core bottom edge lies substantially in said horizontal plane.

6. The ornament of claim 3 wherein said cord section of enlarged diameter comprises a knot joining the end portions of said cord together to form the cord loop.

7. The ornament of claim 3 wherein said stabilizing element is more rigid than said metal foil.

8. The ornament according to claims 1 or 3 wherein the portion of said strip radially close to said core has taller fingers than the portion of said strip radially further from said core.

9. The ornament according to claims 1 or 3 wherein said fingers increase in length from the radially inner portion of the winding formed by said strip to the radially outer portion thereof.

10. The ornament according to claims 1 or 3 wherein said core is a distinct and separate entity from said strip.

11. The ornament of claim 1 wherein said core is formed of a different material than said strip.

12. The ornament of claim 11 wherein said core is formed of a material more rigid than said strip.

* * * * *